US010641199B2

(12) United States Patent
Dölker

(10) Patent No.: US 10,641,199 B2
(45) Date of Patent: May 5, 2020

(54) METHOD FOR OPERATING AN INTERNAL COMBUSTION ENGINE, DEVICE FOR THE OPEN-LOOP AND/OR CLOSED-LOOP CONTROL OF AN INTERNAL COMBUSTION ENGINE, INJECTION SYSTEM AND INTERNAL COMBUSTION ENGINE

(71) Applicant: MTU FRIEDRICHSHAFEN GMBH, Friedrichshafen (DE)

(72) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 16/096,898

(22) PCT Filed: Mar. 13, 2017

(86) PCT No.: PCT/EP2017/000324
§ 371 (c)(1),
(2) Date: Oct. 26, 2018

(87) PCT Pub. No.: WO2017/186326
PCT Pub. Date: Nov. 2, 2017

(65) Prior Publication Data

US 2019/0136788 A1 May 9, 2019

(30) Foreign Application Priority Data

Apr. 28, 2016 (DE) ..... 10 2016 207 297

(51) Int. Cl.
*F02M 1/00* (2006.01)
*F02D 41/38* (2006.01)
(Continued)

(52) U.S. Cl.
CPC ..... *F02D 41/3872* (2013.01); *F02D 41/042* (2013.01); *F02D 41/062* (2013.01); *F02D 2200/0602* (2013.01); *F02D 2250/31* (2013.01)

(58) Field of Classification Search
CPC ..... F02D 41/3809; F02M 55/025; F02M 63/005; F02M 63/0225; F02M 63/023;
(Continued)

(56) References Cited

U.S. PATENT DOCUMENTS 5,711,274 A 1/1998 Drummer
7,025,028 B2 4/2006 Dölker
(Continued)

FOREIGN PATENT DOCUMENTS

DE 19857260 A1 6/1999
DE 19935519 C2 2/2001
(Continued)

*Primary Examiner* — John Kwon
(74) *Attorney, Agent, or Firm* — Lucas & Mercanti, LLP; Klaus P. Stoffel

(57) ABSTRACT

A method for operating an internal combustion engine having a number of cylinders and an injection system having an injection system that has a common rail and a number of injectors associated with the cylinders, wherein an individual accumulator is associated with each injector and stores fuel from the common rail for the injector. The method has the following steps: starting the internal combustion engine, operating the internal combustion engine, shutting off the internal combustion engine. The following steps are also provided: a state indicating an engine standstill is detected, in particular after the internal combustion engine has been shut off, a high-pressure limit value is defined and a target high pressure is specified, a leakage is produced in the common rail without injection, the fuel pressure in the common rail is reduced to the defined high-pressure limit value below the target high pressure by way of the leakage.

12 Claims, 6 Drawing Sheets

(51) Int. Cl.
*F02D 41/04* (2006.01)
*F02D 41/06* (2006.01)

(58) Field of Classification Search
CPC ..... F02M 63/0235; F02M 63/024; F02M 63/0245; F02M 63/025
USPC ..... 123/445, 456, 457, 459
See application file for complete search history.

(56) References Cited

U.S. PATENT DOCUMENTS 7,204,233 B2 * 4/2007 Nagai ..... F02D 41/3863 123/447
7,240,667 B2 7/2007 Dölker
7,848,868 B2 * 12/2010 Nakagawa ..... F02D 41/3863 123/357
7,856,961 B2 12/2010 Dölker
2005/0257775 A1 11/2005 Kojima
2006/0065242 A1 * 3/2006 Nagai ..... F02D 41/3863 123/458
2006/0065870 A1 * 3/2006 Mori ..... F02M 59/34 251/129.07
2006/0090733 A1 * 5/2006 Fujii ..... F02D 41/2438 123/446
2007/0034819 A1 * 2/2007 Mitsumata ..... F02M 63/0015 251/129.14
2007/0079807 A1 * 4/2007 Toyoshima ..... F02M 57/025 123/446
2007/0144490 A1 * 6/2007 Serra ..... F02D 41/3872 123/458
2008/0059039 A1 * 3/2008 Nakagawa ..... F02D 41/2464 701/99
2010/0280743 A1 11/2010 Hehle
2011/0030655 A1 * 2/2011 Kaneko ..... F02D 41/22 123/456
2017/0067409 A1 3/2017 Dölker
2018/0087479 A1 * 3/2018 Bean ..... F02M 59/46

FOREIGN PATENT DOCUMENTS

DE 10156637 C1 5/2003
DE 10360332 A1 7/2005
DE 102004039311 A1 2/2006
DE 102008036299 B3 12/2009
DE 102009002793 84 7/2011
DE 102013214831 A1 2/2015
DE 102014213648 B3 10/2015
EP 0896145 A2 2/1999
JP 2009079514 A 4/2009

* cited by examiner $$\text{Gradient}^{HD}_{Aktuell}(t_1)=\frac{p_{mess}(t_1)-p_{mess}(t_1-\Delta t^{HD}_{Grad})}{\Delta t^{HD}_{Grad}}$$

$$\text{Gradient}^{HD}_{Mittel}(t_1)=\frac{\sum_{i=0}^{k-1}\text{Gradient}^{HD}_{Aktuell}(t_1-i\,Ta)}{k}\;;\quad k=\frac{\Delta t^{HD}_{Mittel}}{Ta}$$

METHOD FOR OPERATING AN INTERNAL COMBUSTION ENGINE, DEVICE FOR THE OPEN-LOOP AND/OR CLOSED-LOOP CONTROL OF AN INTERNAL COMBUSTION ENGINE, INJECTION SYSTEM AND INTERNAL COMBUSTION ENGINE

CROSS-REFERENCE TO RELATED APPLICATIONS

The present application is a 371 of International application PCT/EP2017/000324, filed Mar. 13, 2017, which claims priority of DE 10 2016 207 297.8, filed Apr. 28, 2016, the priority of these applications is hereby claimed and these applications are incorporated herein by reference.

BACKGROUND OF THE INVENTION

Method for operating an internal combustion engine with an engine comprising a number of cylinders and an injection system with high-pressure components, in particular an injection system comprising a common rail with a number of injectors associated with the cylinders, in particular wherein a single reservoir that is embodied for holding fuel from the common rail for an injector is associated with the injector.

The concept of an injector with a single reservoir in the context of a common-rail injection system has been proved, such as for example as is described in DE 199 35 519 C2 by way of example. The single reservoir is supplied with fuel under pressure via a fuel feed channel from the pressure connector and has a direct fluid connection to the high-pressure channel for the fuel under high pressure in the common rail. The volume of the single reservoir is large compared with the volume of the high-pressure channel and the nozzle pre-chamber in the injector. Because of the arrangement of the injector—possibly decoupled from the common rail by means of a choke element—there is sufficient space within the housing of the fuel injector in the single reservoir to provide fuel for at least one complete injection quantity for a working cycle of a cylinder, but in any case for a partial injection during the working cycle.

DE 10 2009 002 793 B4 discloses a single reservoir or a high-pressure component such as a common rail with a pressure measuring device embodied in the form of a strain sensor, wherein the strain sensor is embodied in the form of a strain gauge and is disposed on the outside of a wall of the single reservoir, and a hydraulic resistance is disposed immediately upstream or downstream of the single reservoir for integration within the high-pressure feed.

When starting the engine, on the one hand it must be ensured that the high pressure does not exceed a maximum value of, for example, 600 bar specified by the pump manufacturer, because otherwise the pump can be damaged because of the excessive counter-pressure. On the other hand, the high pressure should be as high as possible when starting the engine in order to ensure good acceleration behavior and low emissions.

The actuation of the suction choke when starting the engine according to the prior art is described in the patent specification DE 101 56 637 C1. In this case, the suction choke is energized with a constant energization value, preferably 0 A, with the engine off or with the engine running until reaching a high pressure threshold value of, for example, 800 bar. On reaching the threshold value, the high pressure control is activated, whereby the suction choke is energized so that the high pressure is controlled to the setpoint high pressure. Said method is particularly advantageous for common-rail systems with a large system leak. With systems of this type, the rail pressure, i.e. the fuel pressure in the common rail, decreases rapidly to a low value after the engine is stopped, for example to 0 bar. If the suction choke is initially not energized in this case after starting the engine, then a maximum rise in the high pressure is achieved up to a specifiable high-pressure threshold value. This enables a rapid and reliable engine start, because on the one hand injections in common-rail systems are only possible if the opening pressure of the injection nozzles is achieved. The magnitude of said opening pressure is usually 350-400 bar. On the other hand, the engine can be accelerated faster at higher high pressures, because the fuel is combusted better in this case, whereby higher efficiency results.

While this is correct in principle, nevertheless the following problem has proved to be relevant: with new common-rail systems, actuation of the suction choke according to the prior art is less advantageous, because said systems only have a slight system leak. The result of this is that the high pressure is not decreased when stopping the engine and therefore remains at values that prevail at the point in time of stopping. Because the engine is operated at high pressures of 600-2200 bar, before starting the engine as a rule a high pressure prevails that could damage the high-pressure pump of the injection system.

It is therefore desirable to set the pressure prevailing within the injection system at the point in time of starting the engine within a predetermined range of values that is low enough in order to not damage the high-pressure pump of the injection system, and at the same time is high enough in order to have good acceleration behavior and advantageous emission behavior.

In order to satisfy the aforementioned requirements in an improved manner, a method must be developed that sets the pressure prevailing within the injection system at the point in time of starting the engine consistent with a predetermined range of values.

SUMMARY OF THE INVENTION

At this point, the invention starts, the object of which is to develop a method that decreases the high pressure to just below the setpoint high pressure before the engine is started and that activates the high pressure control as rapidly as possible when starting the engine.

The invention is based on a method for operating an internal combustion engine with an engine comprising a number of cylinders and an injection system with high-pressure components, in particular an injection system comprising a common rail with a number of injectors associated with the cylinders, in particular wherein a single reservoir that is embodied to hold fuel from the common rail for an injector is associated with an injector, wherein the method comprises the steps:

starting the internal combustion engine, operating the internal combustion engine, stopping the internal combustion engine, According to the invention, with the method the steps are provided such that

- a state characterizing a stopped engine is detected, in particular after stopping the internal combustion engine,
- a high pressure limit value is determined and a setpoint high pressure is specified,
- a leak is produced in the common rail without injection, by means of the leak, the fuel pressure in the common rail is reduced to the specified high pressure limit value below the setpoint high pressure.

The device is used to control and/or regulate an internal combustion engine with an engine controller and an injection computer module that are embodied to carry out the method according to the invention. The injection system is provided with a common rail for an internal combustion engine with an engine comprising a number ofcylinders and with a number of injectors associated with the cylinders, wherein a single reservoir that is embodied for holding fuel from the common rail for injection into the cylinder is associated with an injector, and with a device for controlling and/or regulating an internal combustion engine. The internal combustion engine comprises an engine comprising a number of cylinders and an injection system with a common rail and a number of injectors.

The invention is based on the consideration that the high pressure in the injection system of an internal combustion engine should be reduced before starting, ideally to just below the setpoint high pressure. In this case, the setpoint high pressure must be specified such that the maximum permissible high pressure is not exceeded when starting the engine. If the engine is started, the high pressure control should be activated as rapidly as possible in order to avoid a significant overshoot of the high pressure above the setpoint value.

The invention has recognized that in this way it is guaranteed that on the one hand the high-pressure pump is not damaged by overloading and on the other hand the high pressure is as high as possible when starting the engine in order to guarantee good emission and acceleration behavior. In accordance with the method according to the invention, the object is preferably achieved by decreasing the high pressure after stopping the engine by activating a so-called "blank shot" function. In this case, the injectors are energized with the engine off, whereby a leak is produced, but no injection is carried out. Said "blank shot" function is activated until the high pressure is decreased to a value just below the setpoint high pressure. A significant overshoot of the high pressure after the engine start is prevented according to the invention by already activating the high pressure control when the calculated high pressure gradient exceeds a specifiable limit value.

The concept preferably provides the basis for an internal combustion engine that is operated in an improved manner. The invention enables the engine to start with a very high rail pressure without exceeding the maximum permissible rail pressure and thus without damaging the engine with an excessive rail pressure. Starting with a high rail pressure thus enables good acceleration behavior with low emissions. Starting with a high rail pressure in the region of the maximum permissible rail pressure is achieved by reducing the rail pressure to a value just below the maximum pressure after stopping the engine using the blank shot function on the one hand, and on the other hand activating the rail pressure control early when starting the engine by checking whether the average high pressure gradient exceeds a specifiable limit. Said method thus further enables the suction choke to not have to be energized with the engine off, whereby the durability thereof is extended.

Advantageous developments of the invention are to be found in the subordinate claims and specify advantageous possibilities in detail for realizing the concept described above in the context of the task specification and regarding further advantages.

In particular, it is provided with the method that when starting the internal combustion engine the high pressure control for controlling the fuel pressure is activated while still in the state characterizing the engine being stopped, once an average high pressure gradient reaches or exceeds a defined limit value.

Specifically, in particular this includes already activating the high-pressure control for controlling the fuel pressure at a point in time at which there is still a state characterizing a stopped engine because of an engine revolution rate that is still too low.

As a result, the advantage is achieved that when starting the internal combustion engine the fuel pressure remains below the maximum value and settles at a specified setpoint value sooner.

Furthermore, it is advantageously provided that by activating the high pressure control, a suction choke influencing the fuel feed is actuated in the closing direction, which results in the fuel pressure remaining below a maximum value when starting the internal combustion engine.

Specifically, this includes that a continuous signal for controlling a suction choke is increased on activating the high-pressure control, which results in a closing movement of the suction choke.

As a result, the advantage is achieved that a rise in the fuel pressure above a maximum value is prevented by early closure of the suction choke.

In the context of a further preferred development, it is provided that the high pressure gradient is made up of a first and a second fuel pressure value, wherein one of the first and second fuel pressure values follows the other at a specified time interval.

Specifically, this means for example that two fuel pressure values that are sequential in time and that are measured by means of a pressure sensor are subtracted one from the other and a quotient of said difference and the period of time between the two recordings of the respective values is formed.

Said procedure has the advantage that the high pressure gradient, i.e. the rate of increase, can be used as a criterion for activating the high pressure control instead of the absolute fuel pressure value. In this way, before reaching the maximum magnitude of the fuel pressure, the point in time can be determined at which the increase in the fuel pressure value reaches a predetermined limit value.

In the context of a further preferred development, it is provided that an average high pressure gradient is formed from a finite number of successive high pressure gradients by averaging.

Said procedure results in the advantage that suitable confidence during assessment is achieved by averaging high pressure gradients. Thus, for example, short-term outliers in the measured fuel pressure values are smoothed out by averaging of this type.

Furthermore, it is advantageously provided that an engine at an engine revolution rate of 50-120 $min^{-1}$ is detected as being in operation or running.

Furthermore, it is advantageously provided that the specified high pressure limit value has a magnitude of 560-600 bar.

In the context of a further preferred development, it is provided that the high pressure gradient for a specified period of time is determined as the average high pressure gradient from a number (k) of determined high pressure gradients, wherein the number (k) is formed as a quotient of the specified period of time and a sampling time.

Embodiments of the invention will now be described below using the drawing. This is not necessarily intended to represent the embodiments to scale, rather the drawing is produced in a schematic and/or slightly distorted form where this is useful for explanatory purposes. With regards to additions to the lessons that can be directly learned from the drawing, refer to the relevant prior art. In this case, it is to be taken into account that diverse modifications and alterations relating to the form and the detail of an embodiment can be carried out, without departing from the general idea of the invention. The features of the invention disclosed in the description, in the drawing and in the claims can be significant for the development of the invention both individually and in any combination. In addition, all combinations of at least two of the features disclosed in the description, the drawing and/or the claims fall within the scope of the invention. The general idea of the invention is not limited to the exact form or the detail of the preferred embodiments shown and described below or limited to an object that would be limited in comparison to the object claimed in the claims. In the case of specified dimensional ranges, values lying within the mentioned limits shall also be able to be disclosed and arbitrarily used and claimed as limit values. For the sake of simplicity, the same reference characters are used below for identical or similar parts or parts with identical or similar functions.

Further advantages, features and details of the invention arise from the following description of the preferred embodiments and using the drawing; in the drawings:

DETAILED DESCRIPTION OF THE INVENTION

Figure 1:
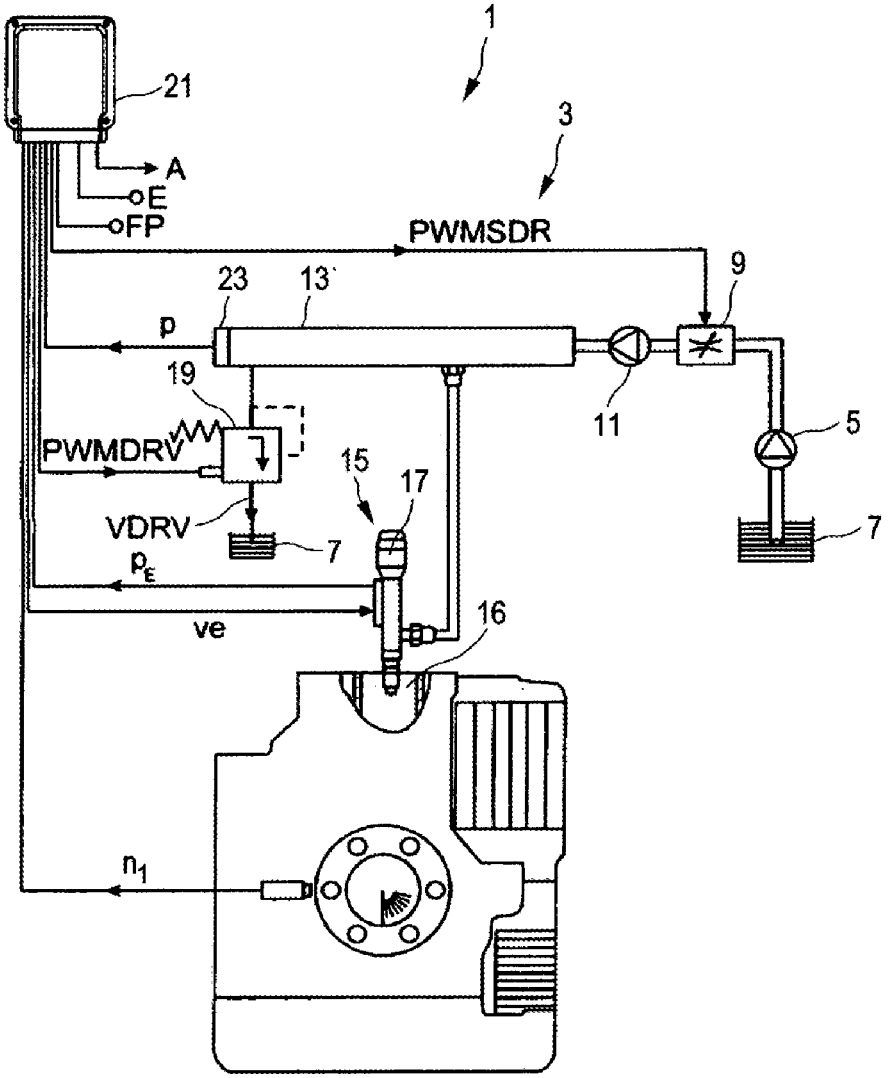
FIG. 1 shows a device for controlling an injection system of an internal combustion engine

FIG. 1 shows a device corresponding to the prior art. A device of this type is described in DE 10 2014 213 648 B3. An internal combustion engine 1 comprises an injection system 3 in this case. The injection system 3 is preferably embodied as a common-rail injection system. Said system comprises a low-pressure pump 5 for transporting fuel from a fuel reservoir 7, an adjustable suction choke 9 on the low-pressure side for influencing a volumetric fuel flow to be carried by means of a high-pressure pump 11, the high-pressure pump 11 for transporting the fuel at a raised pressure into a high-pressure reservoir 13, the high-pressure reservoir 13 for storing the fuel, and preferably a number of injectors 15 for injecting the fuel into combustion chambers 16 of the internal combustion engine 1. Optionally, it is possible that the injection system 3 is also implemented with individual reservoirs, wherein then for example a single reservoir 17 is integrated within the injector 15 as an additional buffer volume. With the exemplary embodiment represented here, an in particular electrically actuatable pressure control valve 19 is provided, by means of which the high-pressure reservoir 13 is fluidically connected to the fuel reservoir 7. By means of the position of the pressure control valve 19, a volumetric fuel flow is defined that is discharged from the high-pressure reservoir 13 into the fuel reservoir 7. Said volumetric fuel flow is referred to in FIG. 1 and in the following text with VDRV and is a high pressure disturbance variable of the injection system 3.

The injection system 3 comprises no mechanical excess pressure valve, because the function thereof is carried out by the pressure control valve 19. The manner of operation of the internal combustion engine 1 is determined by an electronic control unit 21, which is preferably embodied as an engine control unit of the internal combustion engine 1, namely as a so-called Engine Control Unit (ECU). The electronic control unit 21 contains the usual components of a microcomputer system, for example a microprocessor, I/O modules, buffer modules and memory modules (EEPROM, RAM). In the memory modules, the relevant operating data for the operation of the internal combustion engine 1 are applied in characteristic fields/characteristic curves. By means of said characteristic fields/characteristic curves, the electronic control unit 21 calculates output variables from input variables. In FIG. 1, by way of example, the following input variables are represented: A measured, not yet filtered high pressure p prevailing in the high-pressure reservoir 13 and measured by means of a pressure sensor 23, a current engine revolution rate $n_1$, a signal FP for specifying power by an operator of the internal combustion engine 1, and an input variable E. The input variable E is preferably a combination of further sensor signals, for example a charging air pressure of an exhaust turbocharger. In the case of an injection system 3 with individual reservoirs 17, an individual reservoir pressure $p_E$ is preferably an additional input variable of the control unit 21.

In FIG. 1, by way of example a signal PWMSDR for actuating the suction choke 9 as a first pressure control element, a signal ve for actuating the injectors 15 (which in particular specifies a start of injection and/or an end of injection or even a duration of injection), a signal PWMDRV for actuating the pressure control valve 19 and thereby the high pressure disturbance variable VDRV are defined as output variables of the electronic control unit 21. The output variable A is representative of further control signals for controlling and/or regulating the internal combustion engine 1, for example for a control signal for activating a second exhaust turbocharger in the case of a multi-stage turbocharger.

Figure 2:
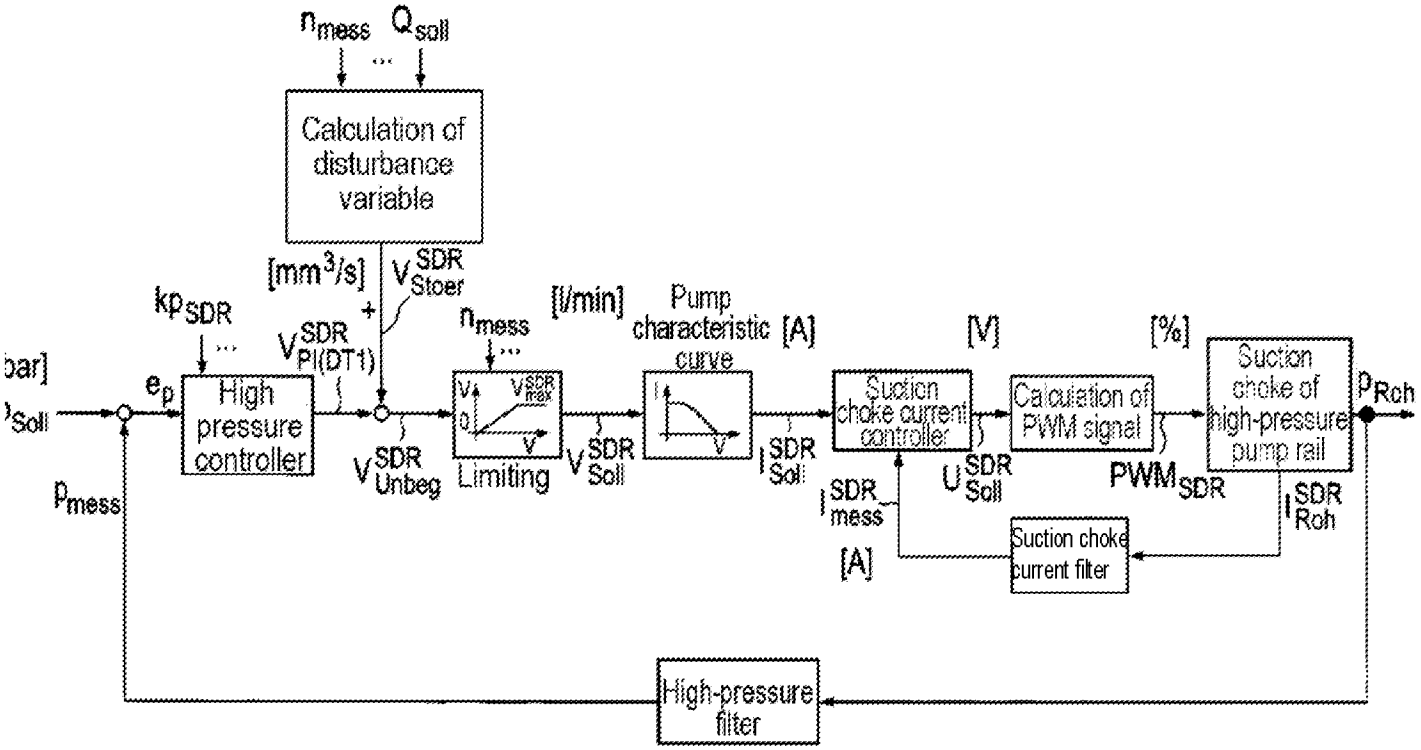
FIG. 2 shows a block diagram of a high pressure control circuit

FIG. 2 shows the block diagram of a high pressure control circuit corresponding to the prior art. The input variable of the high pressure control circuit is the setpoint high pressure $p_{Soll}$ of the common-rail system, which is compared with the measured high pressure $p_{mess}$. In this case, the difference of the two high pressures gives the high pressure control error $e_p$. Said high pressure control error $e_p$ is the input variable of the high pressure controller, which is preferably implemented as a $PI(DT_1)$ algorithm. Further input variables of the high pressure controller are inter alia the proportionality coefficient kpDSR. The output variable of the high pressure controller is the volumetric fuel flow $V_{PI(DT1)}^{SDR}$, which is added to the setpoint fuel consumption $V_{Stör}^{SDR}$. The setpoint fuel consumption $V_{Stör}^{SDR}$ is calculated from the measured engine revolution rate $n_{mess}$ and the setpoint injection quantity $Q_{Soll}$ and constitutes a disturbance variable of the high pressure control circuit. The sum of the high pressure controller output variable $V_{PI(DT1)}^{SDR}$ and the disturbance variable $V_{Stör}^{SDR}$ (disturbance variable connection) gives the unlimited setpoint volumetric fuel flow $V_{Unbeg}^{SDR}$. Said unlimited setpoint volumetric fuel flow $V_{Unbeg}^{SDR}$ is then limited to the maximum volumetric flow $V_{max}^{SDR}$ depending on the engine revolution rate $n_{mess}$. The limited setpoint volumetric fuel flow $V_{Soll}^{SDR}$ is the input variable of the pump characteristic curve. The pump characteristic curve converts the limited setpoint volumetric fuel flow $V_{Soll}^{SDR}$ into the suction choke setpoint current $I_{Soll}^{SDR}$. The suction choke setpoint current $I_{Soll}^{SDR}$ is the input variable of the suction choke current controller, which has the task of controlling the suction choke current. A further input variable of the suction choke current controller is inter alia the measured suction choke current $I_{mess}^{SDR}$. The output variable of the suction choke current controller is the suction choke setpoint voltage $U_{Soll}^{SDR}$, which is finally converted into the PWM duty cycle $PWM_{SDR}$ as the demand for the suction choke. The control path of the high pressure control circuit consists in total of the suction choke, the high-pressure pump and the fuel rail. The control variable of the subordinate suction choke current control circuit is the suction choke current in this case, wherein the raw values $I_{Roh}^{SDR}$ are still filtered by a filter, which can for example be a $PT_1$ filter. The output variable of said filter is the measured suction choke current $I_{mess}^{SDR}$. The control variable of the high pressure control circuit is the fuel rail pressure (high pressure). In this case, the raw values of the fuel rail pressure $p_{Roh}$ are filtered by a high pressure filter, which has the measured fuel-rail pressure $p_{mess}$ as its output variable. Said filter can for example be implemented by a $PT_1$ algorithm.

The following elements of the high pressure control circuit are already published in these patent documents: the current control circuit in U.S. Pat. No. 7,240,667 B2 and the disturbance variable connection for example in DE 10 2008 036 299 B3 or U.S. Pat. No. 7,856,961 B2 for the case of separate fuel rails.

The invention is described using FIG. 3A, FIG. 3B, FIG. 4 and FIG. 5.

Figures 3A, 3B:
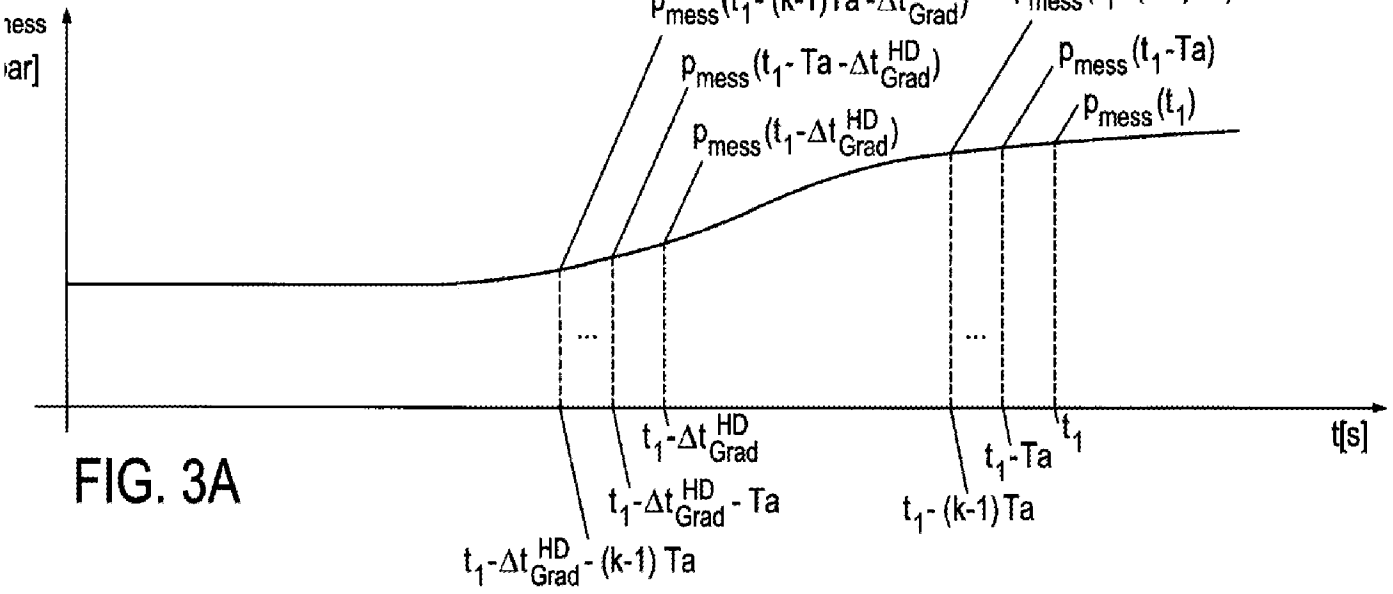
FIG. 3A shows a timing diagram for representing the high pressure gradient
FIG. 3B shows formulae for calculating the high pressure gradient and the average high pressure gradient

FIG. 3A and FIG. 3B represent a particularly advantageous calculation of the high pressure gradient. The timing diagram represented in FIG. 3A shows the high pressure in the form of a solid curve as a function of time. The current high pressure gradient ($Gradient_{Aktuelle}^{HD}(t_1)$) at the point in time $t_1$ is calculated according to FIG. 3B by subtracting the fuel pressure ($p_{mess}(t_1-\Delta t_{Grad}^{HD})$) that was measured at a time in the past by the period of time ($\Delta t_{Grad}^{HD}$) from the current fuel pressure ($p_{mess}(t_1)$) and dividing the difference by the period of time ($\Delta t_{Grad}^{HD}$). The high pressure gradient at the point in time ($t_1-Ta$), wherein the sampling time is denoted by (Ta), is calculated by subtracting the fuel pressure ($p_{mess}(t_1-Ta-\Delta t_{Grad}^{HD})$) measured at a time in the past by the period of time ($t_1-Ta-\Delta t_{Grad}^{HD}$) from the fuel pressure ($p_{mess}(t_1-Ta)$) and likewise dividing the difference by the period of time ($\Delta t_{Grad}^{HD}$). More generally, the high pressure gradient at the point in time ($t_1-(k-1)*Ta$) is calculated by subtracting the fuel pressure ($p_{mess}(t_1-(k-1)*Ta-\Delta t_{Grad}^{HD})$) measured in the past by the period of time ($t_1-(k-1)*Ta-\Delta t_{Grad}^{HD}$) from the fuel pressure ($p_{mess}(t_1-(k-1)*Ta)$) and dividing the difference by the period of time ($\Delta t_{Grad}^{HD}$).

It is an advantageous embodiment of the calculation of the high pressure gradient if said gradient is averaged over the specifiable period of time ($\Delta t_{Mittel}^{HD}$). In this case, according to FIG. 3B, for a sampling time (Ta) the average high pressure gradient ($Gradient_{Mittel}^{HD}(t_1)$) at the point in time $t_1$ results by averaging over a total of (k) gradients, wherein the number (k) is calculated according to FIG. 3B as follows:

$$k = \frac{\Delta t_{Mittel}^{HD}}{Ta}$$

Figures 4A, 4B, 4C:
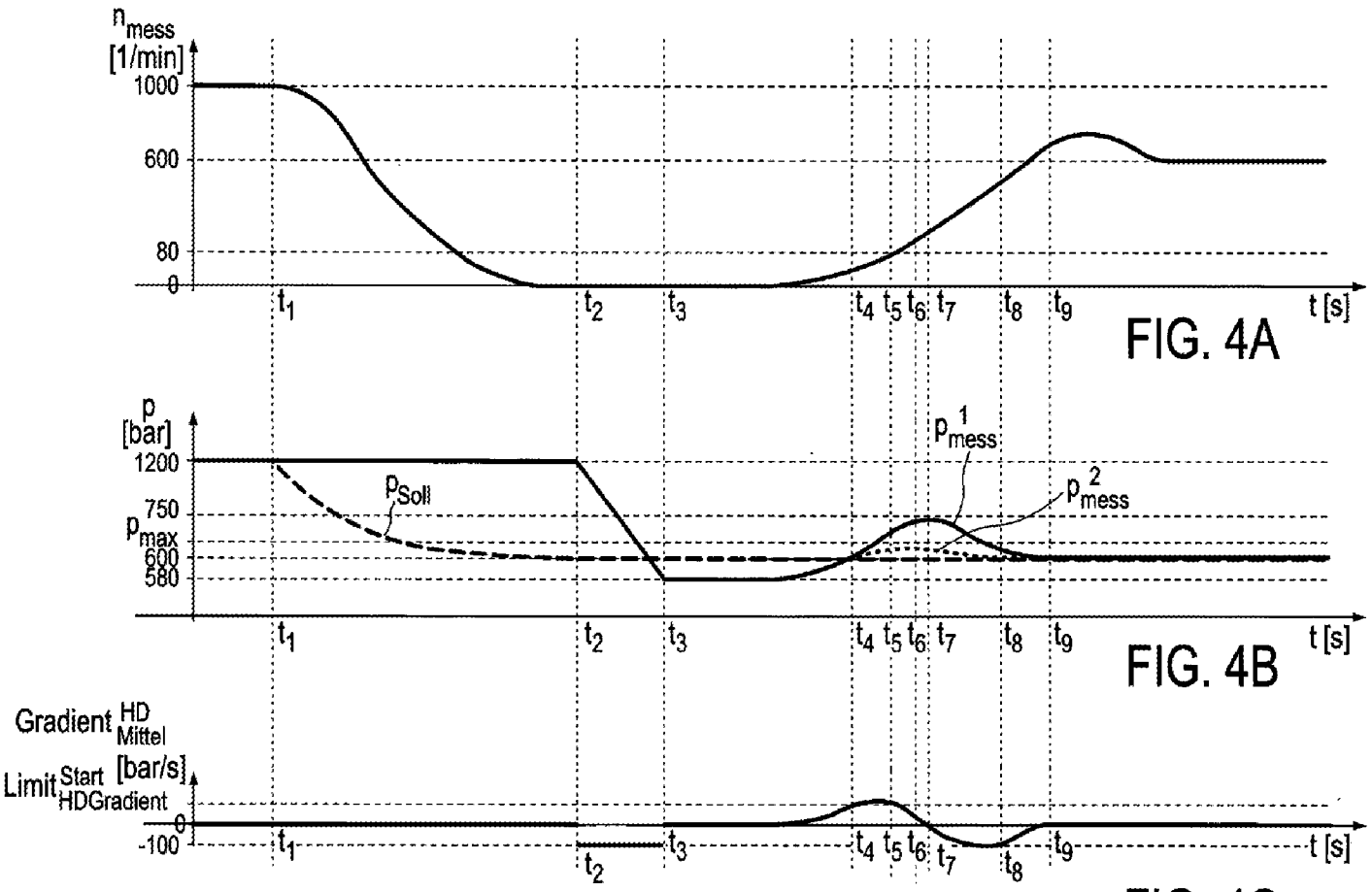
FIG. 4A shows a timing diagram of the measured revolution rate $n_{mess}$
FIG. 4B shows a timing diagram of the measured fuel pressure $p_{mess}$ and the setpoint high pressure $p_{Soll}$
FIG. 4C shows a timing diagram of the high pressure gradient of the fuel pressure
Figures 4D, 4E, 4F, 4G, 4H:
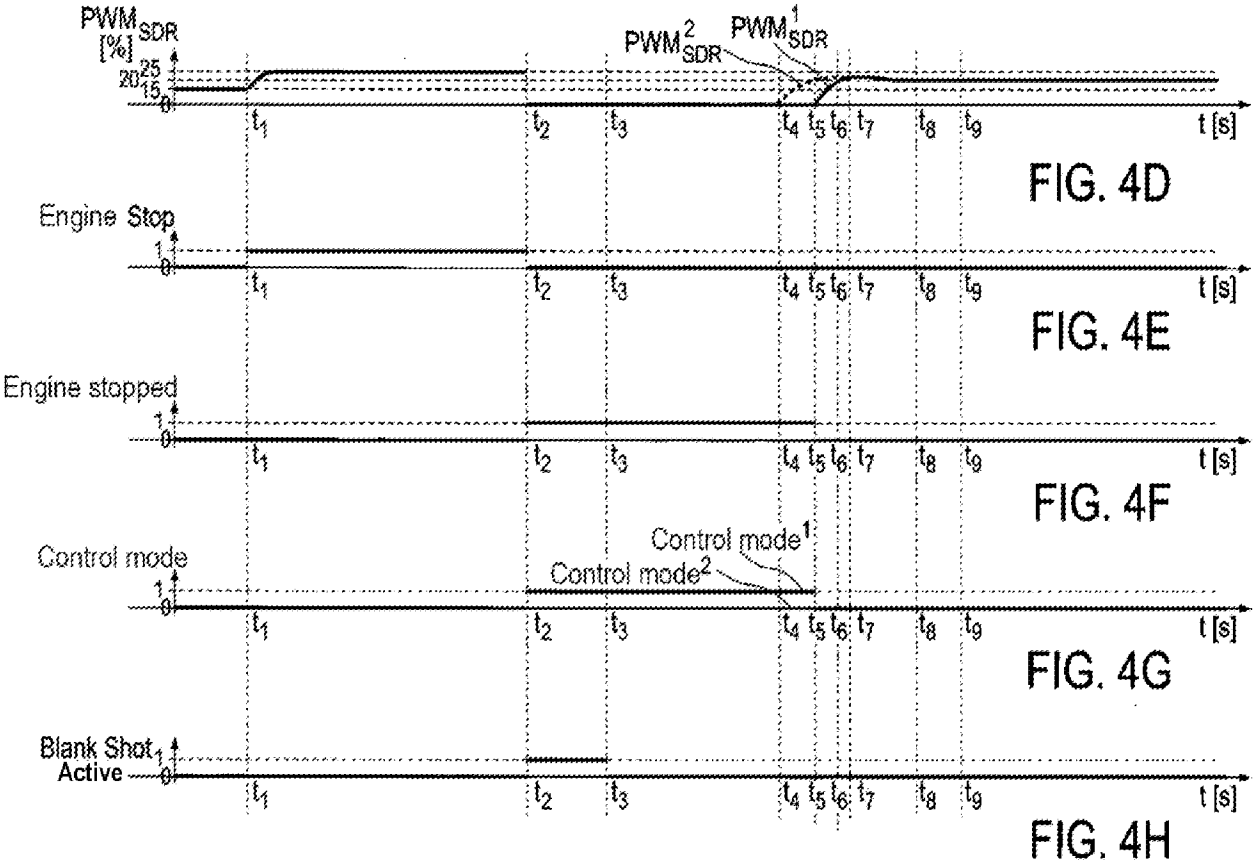
FIG. 4D shows a timing diagram of the duty cycle $PWM_{SDR}$ of the PWM signal
FIG. 4E shows a timing diagram of the signal "engine stop", which characterizes the engine stopping
FIG. 4F shows a timing diagram of the signal "engine stopped", which characterizes a stopped engine
FIG. 4G shows a timing diagram of the signal "control mode", which characterizes activation of the high pressure control
FIG. 4H shows a timing diagram of the signal "blank shot active", which characterizes activation of the blank-shot function

The related figures FIG. 4A, FIG. 4B, FIG. 4C, FIG. 4D, FIG. 4E, FIG. 4F, FIG. 4G and FIG. 4H illustrate the invention in the form of a plurality of timing diagrams. The timing diagram represented in FIG. 4A shows the measured engine revolution rate ($n_{mess}$). At the point in time ($t_1$), the engine is stopped and the "engine stop" signal represented in the timing diagram of FIG. 4E changes from the value 0 to the value 1. As a result, the engine revolution rate ($n_{mess}$) changes, starting from the value 1000 1/min to the value 0 1/min. At the point in time ($t_2$) the stopped engine is detected and the signal ("engine stopped") represented in the timing diagram of FIG. 4F changes from the value 0 to the value 1. In the timing diagram of FIG. 4B, the setpoint high pressure ($p_{soll}$) is represented as a solid light curve. The setpoint high pressure is calculated as the output variable of a three-dimensional characteristic field with the input variables engine revolution rate ($n_{mess}$) and setpoint torque ($M_{Soll}$). If the engine is stopped, the setpoint torque is immediately reduced to the value 0 Nm and the engine revolution rate decreases with a time delay to the value 0 1/min. According to the timing diagram represented in FIG. 4B and corresponding to the design of the setpoint high pressure characteristic field, in this case a decreasing setpoint high pressure ($p_{soll}$) also results, represented by a solid light curve with the initial value 1200 bar and the final value 600 bar, which is achieved at the point in time ($t_2$). The fuel pressure ($p_{mess}^1$) is represented in the timing diagram of FIG. 4B by a dark solid curve. Because there is no further injection in the case of an engine stop and new common-rail systems have no or only very slight system leaks, the fuel pressure ($p_{mess}$) remains constant at the original setpoint value of 1200 bar until the point in time ($t_2$). Accordingly, as illustrated in the timing diagram of FIG. 4C, an average high pressure gradient ($Gradient_{Mittel}^{HD}$) of 0 bar/s is calculated. The timing diagram of FIG. 4D shows the duty cycle ($PWM_{SDR}$) of the PWM signal of the suction choke. Up to the point in time ($t_1$), with the engine running, the PWM signal adopts the value 15%. Because the setpoint high pressure ($p_{Soll}$) decreases from the point in time ($t_1$) to below the fuel pressure ($p_{mess}^1$), a negative high pressure control error ($e_p$) results. As a result, according to FIG. 2 a longer duty cycle ($PWM_{SDR}$) of the PWM signal is calculated, i.e. the suction choke is moved in the closing direction. According to the timing diagram represented in FIG. 4D, the duty cycle ($PWM_{SDR}$) of the PWM signal increases to the maximum value thereof of 25% and remains at said value until the point in time ($t_2$). The duty cycle of the PWM signal is a calculated signal corresponding to FIG. 2 in this case, which is indicated in the timing diagram of FIG. 4G by the control mode adopting the value 0 until the point in time ($t_2$).

At the point in time ($t_2$), according to the timing diagram represented in FIG. 4F, the engine is detected to be stopped and the signal ("engine stopped") changes from the value 0 to the value 1. As the timing diagram represented in FIG. 4H shows, at said point in time the blank shot function is activated, which is indicated by the signal "blank shot active", which changes from the value 0 to the value 1. The result of this is that the fuel pressure ($p_{mess}^1$) represented in FIG. 4B decreases starting from the value 1200 bar and reaches the value 580 bar at the point in time ($t_3$). At said point in time, the blank shot function is deactivated, so that the signal ("blank shot active") changes from the value 1 back to the value 0. Because the fuel pressure decreases from the point in time ($t_2$) until the point in time ($t_3$), as represented in the third timing diagram a negative high pressure gradient results, indicated by the value−100 bar/s.

At the point in time ($t_3$), the engine is started. The result of this is that the engine revolution rate ($n_{mess}$) increases and at the point in time ($t_5$) reaches the value 80 1/min. As a result, at said point in time a running engine is detected and the signal ("engine stopped") changes from the value 1 to the value 0. According to the prior art, the duty cycle ($PWM_{SDR}$) of the PWM signal is only calculated from said point in time and thus the fuel pressure is regulated, i.e. until the point in time ($t_5$) the duty cycle ($PWM_{SDR}$) of the PWM signal is set to the value 0% and thus the fuel pressure is controlled. As a result, the fuel pressure ($p_{mess}^1$) increases starting at point in time ($t_3$) according to the prior art, and thus the maximum value thereof of 750 bar is only achieved at the point in time ($t_7$) following the activation of the high pressure control at the point in time ($t_5$). Following the point in time ($t_7$), the fuel pressure decreases again and at the point in time ($t_9$) finally reaches the setpoint value ($p_{soll}$) thereof. The timing diagram in FIG. 4B shows that the fuel pressure ($p_{mess}^1$) significantly exceeds the permitted maximum pressure ($p_{max}$) when starting the engine. The diagram represented in FIG. 4D shows that the duty cycle ($PWM_{SDR}^1$) of the PWM signal corresponding to the prior art increases at the point in time ($t_5$) with the activation of the high pressure control and finally settles at the static value 20% thereof at the point in time ($t_9$). The diagram represented in FIG. 4G shows the control mode (Steuermodus$^1$) corresponding to the prior art. As with the diagrams represented in FIG. 4B and FIG. 4D, the prior art is again represented as a solid curve. It can be seen that the control mode (Steuermodus$^1$) equals the value 1 until the point in time ($t_5$), i.e. until the high pressure control is deactivated at said point in time, so that the duty cycle of the PWM signal ($PWM_{SDR}$) is specified. Only at the point in time ($t_5$) does the control mode (Steuermodus$^1$) change to the value 0, so that the fuel pressure ($p_{mess}^1$) is controlled as a result.

The diagram represented in FIG. 4C shows that the high pressure gradient ($Gradient_{Mittel}^{HD}$) increases from the point in time ($t_3$) according to the increasing fuel pressure in accordance with the diagram represented in FIG. 4B, and reaches the limit value ($Limit_{HDGradient}^{Start}$) at the point in time ($t_4$). In the sense of the invention, the high pressure control is activated on reaching said limit value and thus at the point in time ($t_4$). The control mode, represented in FIG. 4G, thus already changes to the value 0 at the point in time ($t_4$). The corresponding curve is shown dotted and is denoted by (Steuermodus$^2$). With the activation according to the invention of the high pressure control at the point in time ($t_4$), the PWM signal is already increasing at the point in time ($t_4$) according to the diagram represented in FIG. 4D, so that the suction choke is actuated in the closing direction earlier than according to the prior art.

The PWM signal corresponding to the invention is again shown dotted and denoted by ($PWM_{SDR}^2$). The earlier onset of the high pressure control according to the invention results in the fuel pressure remaining below the maximum value ($p_{max}$) when starting the engine and settling at the setpoint value ($Pso_{11}$) thereof earlier, i.e. already at the point in time ($t_8$). As a result, the engine is protected when starting. The fuel pressure profile resulting in this case is again shown dotted in the diagram of FIG. 4B. The fuel pressure is denoted by ($p_{mess}^2$) in this case.

Figure 5:
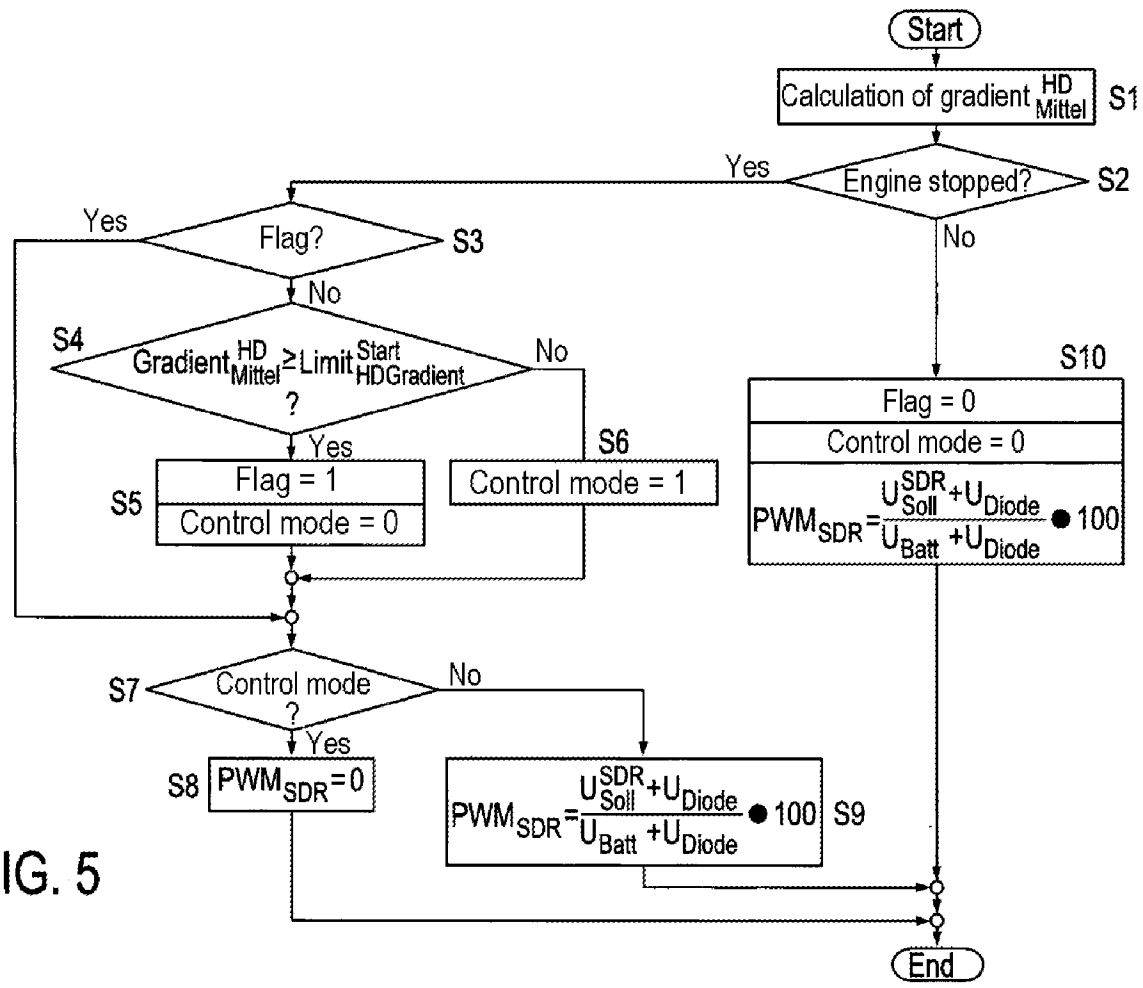
FIG. 5 shows a flow chart of a method of a preferred embodiment.

FIG. 5 illustrates the method according to the invention in the form of a flow chart. In step (S1), in this case the average gradient ($Gradient_{Mittel}^{HD}$) is calculated according to FIG. 3. Then the process continues at step (S2). In step (S2), a query is made as to whether the engine is stopped. If this is the case, the process continues at step (S3). In step (S3), a flag that is initialized with the value 0 is polled. If said flag is set, the process continues at step (S7). If the flag is not set, the process continues at step (S4). In step (S4), a check is carried out as to whether the gradient ($Gradient_{Mittel}^{HD}$) is greater than or equal to the limit value ($Limit_{HDGradient}^{Start}$). If this is the case, the process continues at step (S5). In step (S5), the flag is set to the value 1 and the control mode is set to the value 0. Then the process continues at step (S7). If the result of the polling in step (S4) is negative, i.e. the average gradient ($Gradient_{Mittel}^{HD}$) is less than the limit value ($Limit_{HDGradient}^{Start}$), the control mode is set to the value 1 in step (S6). Then the process continues at step (S7). In step (S7), the control mode is polled. If the control mode is set, the duty cycle ($PWM_{SDR}$) of the PWM signal is set to the value 0 in step (S8). If the control mode is not set, the duty cycle ($PWM_{SDR}$) of the PWM signal is calculated in the step (S9) as a function of the suction choke setpoint voltage ($U_{Soll}^{SDR}$), the battery voltage ($U_{Batt}$) and the diode forward voltage ($U_{Diode}$). In both cases, the program execution is thereby ended.

If the result of the polling in step (S2) is negative, the process continues at step (S10). In step (S10), the flag and the control mode are reset to the value 0. The duty cycle ($PWM_{SDR}$) of the PWM signal is calculated as a function of the suction choke setpoint voltage ($U_{Soll}^{SDR}$), the battery voltage ($U_{Batt}$) and the diode forward voltage ($U_{Diode}$). The program execution is thus ended in this case also.

The invention claimed is:

1. A method for operating an internal combustion engine having a number of cylinders and an injection system comprising a common rail with a number of injectors associated with the cylinders and similar high-pressure components, the method comprising the steps of:

starting the internal combustion engine;

operating the internal combustion engine;

stopping the internal combustion engine;

detecting a state characterizing a stopped engine;

determining a high pressure limit value and specifying a setpoint high pressure;

producing a leak in the common rail without injection; and decreasing fuel pressure in the common rail to a specified high pressure limit value below the setpoint high pressure by way of the leak, wherein when starting the internal combustion engine a high pressure control for regulating the fuel pressure is activated while still in the state characterizing the stopped engine, once an average high pressure gradient reaches or exceeds a defined limit value.

2. The method according to claim 1, wherein by activating the high pressure control a suction choke influencing fuel feed is actuated in a closing direction, which results in the fuel pressure remaining below a maximum value when starting the internal combustion engine.

3. The method according to claim 1, wherein the high pressure gradient is made up of a first pressure valve and a second fuel pressure value, wherein one of the first and the second fuel pressure values follows the other of the first and the second fuel pressure values at a specified time interval ($\Delta t_{Grad}^{HD}$).

4. The method according to claim 1, including forming an average high pressure gradient from a finite number of successive high pressure gradients by averaging.

5. The method according to claim 1, including detecting the engine as being in operation at an engine revolution rate of 50-120 $min^{-1}$.

6. The method according to claim 1, wherein a magnitude of the specified high pressure limit value is 560-600 bar.

7. The method according to claim 1, wherein the high pressure gradient for a specified period of time ($\Delta t_{Mittel}^{HD}$) is determined as the average high pressure gradient from a number (k) of determined high pressure gradients, wherein the number (k) is formed as a quotient of the specified period of time ($\Delta t_{Mittel}^{HD}$) and a sampling time (Ta).

8. A device for controlling and/or regulating an internal combustion engine, comprising: an engine controller; and an injection computer module, the engine controller and the injection computer module are configured to carry out a method according to claim 1.

9. An injection system, comprising: a common rail for an internal combustion engine having a number of cylinders; a number of injectors associated with the cylinders; a single reservoir embodied for holding fuel from the common rail for injection into the cylinder is associated with an injector; and a device according to claim 8 for controlling and/or regulating the internal combustion engine.

10. An internal combustion engine, comprising: a number of cylinders; an injection system with a common rail and a number of injectors and similar high-pressure components; and a device for control and/or regulation as claimed in claim 8.

11. The method according to claim 1, wherein a single reservoir that is embodied for holding fuel from the common rail for an injector is associated with the injector.

12. The method according to claim 1, including detecting the state characterizing the stopped engine after stopping the internal combustion engine.

* * * * *